United States Patent [19]

Ito et al.

[11] Patent Number: 4,686,422

[45] Date of Patent: Aug. 11, 1987

[54] HIGH-PRESSURE METAL VAPOR DISCHARGE LAMP WITH CHARACTERISTIC FUSE ACTION

[75] Inventors: Akira Ito; Yuji Danno; Kouzou Kawashima, all of Yokohama, Japan

[73] Assignee: Kabushiki Kaisha Toshiba, Kawasaki, Japan

[21] Appl. No.: 730,129

[22] Filed: May 3, 1985

[30] Foreign Application Priority Data

May 4, 1984 [JP] Japan ..... 59-64797[U]
Jun. 11, 1984 [JP] Japan ..... 59-118197

[51] Int. Cl.[4] ..... H01J 7/44; H01J 13/46; H01J 17/34

[52] U.S. Cl. ..... 315/74; 315/63; 315/50; 315/73

[58] Field of Search ..... 315/74, 73, 119, 58; 337/199

[56] References Cited

U.S. PATENT DOCUMENTS

| | | | |
|---|---|---|---|
| 2,156,988 | 5/1939 | Jancke et al. | 315/74 |
| 2,494,917 | 1/1950 | Van Liempt | 315/74 |
| 3,727,091 | 4/1973 | DeCaro | 315/74 |
| 3,796,914 | 3/1974 | De Caro et al. . | |
| 3,849,691 | 11/1974 | Collins | 313/318 |
| 3,864,598 | 2/1975 | Cardwell, Jr. . | |
| 4,599,543 | 7/1986 | Strok | 315/74 |

FOREIGN PATENT DOCUMENTS 630536 5/1936 Fed. Rep. of Germany .

OTHER PUBLICATIONS

Patent Abstract of Japan, E. section, vol. 6, No. 238, 11/26/82.
The Patent Office Japanese Gov., p. 79 E 144 Kokai-No. 57-138 767 (Iwasaki Denki).
The Patent Office Japanese Govt., Publication No. 57-138767.
The Patent Office Japanese Govt., Publication No. 59-108258.
The Patent Office Japanese Govt., Publication No. 57-138767.
The Patent Office Japanese Govt., Publication No. 59-108258.

*Primary Examiner*—Palmer C. DeMeo
*Assistant Examiner*—T. C. Salindong
*Attorney, Agent, or Firm*—Cushman, Darby & Cushman

[57] ABSTRACT

A high-pressure metal vapor discharge lamp comprising an outer tube, a light emitting tube located within the outer tube and made of a light-transmissive ceramics material, and a fuse electrically connected in series with the light emitting tube, in which said fuse has such a blowing characteristic as given by the following equation and at a rated output during the lighting of the lamp the density of a current through the fuse is not more than 23.9 A/mm$^2$:

$\log T_1 < A \log I + B$ $A = -1.02 \times 10^{-2}(D^2t) - 0.885$ $B = 2.64 \times 10^{-2}(D^2t) + 1.01$ T: required blowing time (seconds) of the fuse
I: blowing current (A) of the fuse
D: inner diameter (mm) of the light emitting tube
t: wall thickness (mm) of the light emitting tube.

6 Claims, 18 Drawing Figures

LAMP INPUT 150W

LAMP INPUT 1000W

HIGH-PRESSURE METAL VAPOR DISCHARGE LAMP WITH CHARACTERISTIC FUSE ACTION

BACKGROUND OF THE INVENTION

I. Field of the Invention

This invention relates to a high-pressure metal vapor discharge lamp equipped with a fuse.

II. Description of the Prior Art

In general, a high-pressure metal vapor discharge lamp comprises an outer tube and a light emitting tube located within the outer tube and made of a light-transmissve ceramics material. The high-pressure metal vapor discharge lamp is used in combination with a ballast as a current limiting unit, since the light emitting tube per se has no current limiting function. A choking coil is used as the ballast, which is comprised of many turns of an insulated metal wire on an iron core, and is used in combination with, for example, a capacitor.

The ballast has usually a lifetime of 8 to 10 years, because the current limiting function is lowered often due to the degradation of the insulating material. For example, a high-pressure sodium lamp involving a high starting voltage is started by applying starting high-voltage pulse from a pulse generator to the electrodes of the light emitting tube. The pulse generator is incorporated in the ballast exclusively for the high-pressure sodium lamp or within the outer tube of the lamp. It has been found that the ballast at the beginning of the deterioration of the insulating material is dielectrically broken down due to the application of a high-voltage pulse and the heat generation of the ballast per se, with the result that shortcircuiting occurs between the turns or windings of the coil. In this case, the ballast fails to perform its original current-limiting function, causing an excess current to flow through the lamp. As a result, a lamp input to the light emitting tube is increased, causing a sharp increase in the pressure of sealed gas within the light emitting tube to burst the light emitting tube and thus the outer tube with the result that their fragments might fall down.

Two types of breakdowns may occur on the ballast: (1) one occurring between the turns of the coils to which high voltage applies at the start of the lamp, i.e., at the time when a pulse is generated and (2) the other occurring between the turns of the coils due to the heat generation of the ballast per se beginning to experience a lowered breakdown voltage at the ordinary lighting period. In the former case (1), the breakdown is liable to occur when a lamp having a starting device, such as a pulse generator, incorporated within the outer tube is used in combination with a mercury-vapor lamp ballast. The mercury-vapor lamp ballast is used for the high-pressure sodium lamp, since it is compact and inexpensive. Furthermore, the ballast is used for the mercury-vapor lamp which can be ignited without the necessity of applying a high-voltage pulse thereto, providing a simple arrangement in comparison with a ballast for exclusive use. However, the above-mentioned dielectric breakdown may occur at such ballast owing to the application of a high-voltage pulse thereto. In the latter case (2), the dielectric breakdown may take place when the lamp which does not contain any starting device is used in combination with the exclusive ballast.

Japanese Patent Disclosure (KOKAI) No. 57-138767, for example, shows a countermeasure against the dielectric breakdown of the type as set out in connection with (1). In this document, a fuse having a specific blowing characteristic is incorporated into a feed circuit to a light emitting tube. When the ballast is broken down to cause an excess current to flow through the feed circuit, the fuse is blown to prevent a possible breakage of the light emitting tube. However, such prevention means is applicable only to a special high-pressure sodium lamp and not applicable to various high-pressure sodium lamps of different sizes and types. Particularly where it is directly applied to a lamp of a type having no starting device within an outer tube and adapted to be used in combination with an exclusive ballast, no desired effects has not been obtained therefrom.

Where, on the other hand, the fuse is incorporated into the feed circuit of the light emitting tube, there is a possibility that the fragments of the blown fuse will be scattered onto the inner surface of the outer tube to cause a breakage to the outer tube, or that a hot fuse will sag due to a thermal expansion resulting from a rise in temperature, thus shortcircuiting owing to its contact with the other conductive member.

In order to cope with such problems, the inventors have proposed disposing a fuse 20 in an insulating tube as shown in FIGS. 1 to 3, thereby preventing the sagging of a hot fuse or preventing a blown fuse from being scattered onto the inner surface of the outer tube.

FIG. 1 shows an insulating tube 23 having open ends and into which a fuse 20 is disposed; FIG. 2 shows the inslating tube 23 as shown in FIG. 1 which has sealed ends; and FIG. 3 shows the insulating tube 23 of FIG. 1 which has open ends merely blocked by blocking members 25*a*, 25*b* without being bonded. However, this arrangement leaves much to be improved in spite of the above-mentioned advantage.

That is, in the arrangement shown in FIG. 1, the fuse 20 is merely contained in the insulating tube 23 with the open ends. There is a possibility that the tube 23 will move to the position apart from the fuse. It is therefore necessary to fix the insulating tube 23 to an associated member through a special supporting means 26. Furthermore, this arrangement requires lots of time and labor and involves a high material cost. There is also possibility that some fragments of a blown fuse scatters through the open ends of the insulating tube 23. In the arrangement shown in FIG. 2, it is indeed possible to completely prevent the fragments of the blown fuse from being scattered beyond the insulating tube 23 due to the sealed ends of the tube. However, a crack may occur at the sealed ends of the tube owing to a difference in a thermal expansion between the fuse and the insulating tube, and more time is required in the sealing operation. In the arrangement shown in FIG. 3, no drawbacks as encountered in the arrangements of FIGS. 1 and 2 are not produced due to the presence of the blocking members 25*a*, 25*b* and the mere insertion of the blocking members into the open ends of the tube. However, more time and labor are required upon assembly and the structure requires more material costs. Since the insulating tube 23 is of a movable type, a support means 26 is required, as in the arrangement of FIG. 1, when assembly is to be carried out.

SUMMARY OF THE INVENTION

It is accordingly an object of this invention to provide a high-pressure metal vapor discharge lamp which, when an excess current flows through a light emitting tube due to the degeneration of a ballast, can prevent a possible breakage of the light emitting tube.

Another object of this invention is to provide a high-pressure metal vapor discharge lamp which has a fuse of such a blowing characteristic as to be applied to high-pressure metal vapor discharge lamps of different sizes and types.

Another object of this invention is to provide a high-pressure metal vapor lamp having a low-cost fuse, which is easier to assemble and can prevent a possible breakage of an outer tube as has been encountered in the prior art lamp due to the scattering of a blown fuse onto the inner surface of the outer tube and can prevent a possible short-circuit between the fuse and a nearby metal member on account of the sagging of the fuse resulting from a rise in temperature.

According to this invention there is provided a high-pressure metal vapor discharge lamp which comprises an outer tube, a light emitting tube disposed within the outer tube and made of a light-transmissive ceramics material, and a fuse located within the outer tube and electrically connected in series with the light emitting tube. The fuse has a blowing characteristic satisfying the density of the current through the fuse during the lighting of the discharge lamp at a rated output is below 23.9 A/mm$^2$.

$\log T_1 < A \log I + B$ $A = -1.02 \times 10^{-2}(D^2 t) - 0.885$ $B = 2.64 \times 10^{-2}(D^2 t) + 1.01$ $T_1$: the required blowing time (seconds) of the fuse;

I: the blowing current (A) through the fuse;

D: the inner diameter (mm) of the light emitting tube; and t: the wall thickness (mm) of the light emitting tube.

In the discharge lamp of this invention, the fuse is preferred to have a length of 15 to 20 mm. A stopper may be provided at those portions of a fuse member where the fuse member extends through the insulting tube via the diameter-reduced tube ends without being sealed. In this connection it is to be noted that the fuse member is comprised of a fuse and lead wires connected thereto.

This invention is not restricted only to the high-pressure sodium lamp and is applicable to the other types of high-pressure metal vapor discharge lamp, such as a metal halide lamp, with a light-transmission ceramics tube as a light emitting tube.

DETAILED DESCRIPTION OF THE PREFERRED EMBODIMENT

This invention will be explained in more detail below in connection with experiments and embodiments.

Expermient 1

Figure 4:
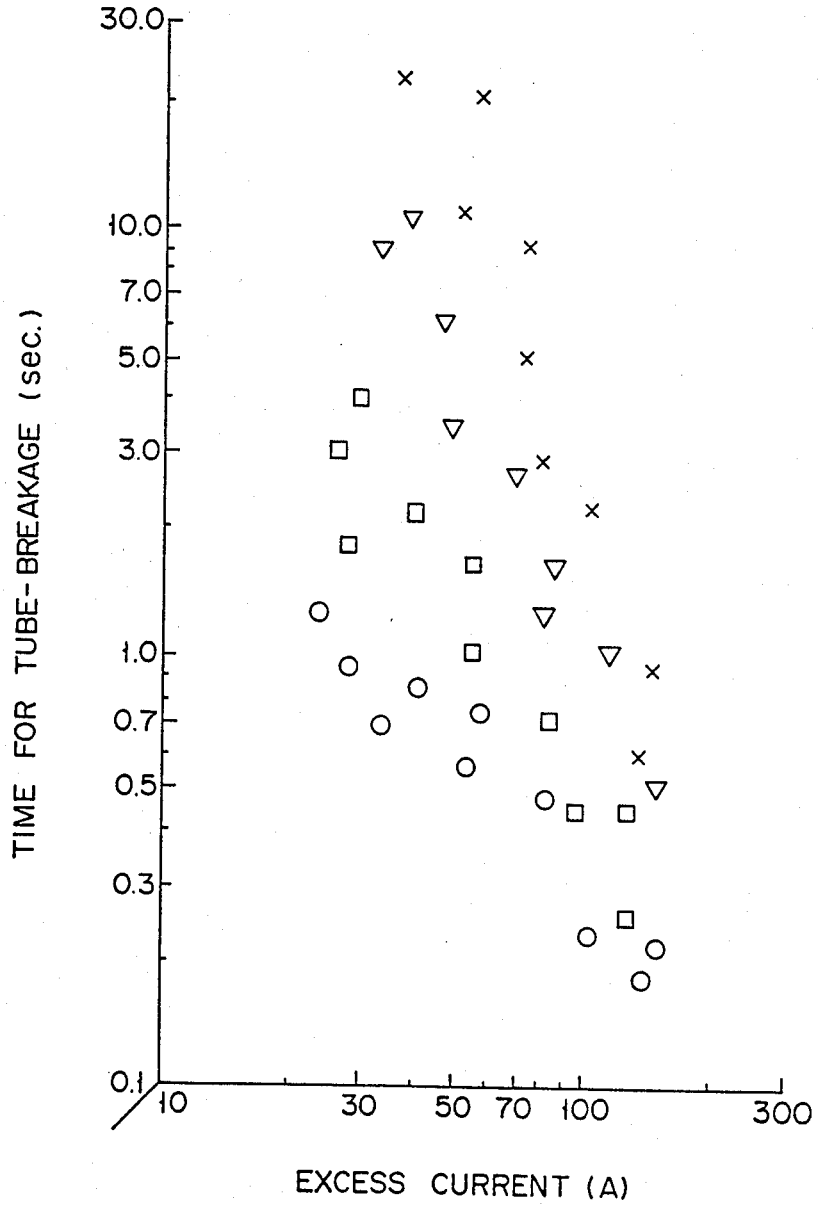
FIG. 4 is a graph showing a relation between an excess current of light-emitting tubes of high-pressure sodium lamps, having different inner diameters and wall thicknesses for various inputs, and a time required for a breakage of the light-emitting tube to occur.

FIG. 4 shows the results of experiments showing a relation between the inner diameter and wall thickness of a light emitting tube of a high-pressure sodium lamp for various inputs and a time required for a breakage to occur when an excess current flows through the light emitting tube during the lighting of the lamp. Table I below shows an input (W) of eachlamp used in the experiments and the inner diameter and wall thickness of the light emitting tube.

TABLE 1

| | light emitting tube | |
|---|---|---|
| lamp input (W) | inner diameter D (mm) | wall thickness t (mm) |
| 150 | 5.5 | 0.5 |
| 400 | 7.25 | 0.75 |
| 700 | 10.0 | 1.0 |
| 1,000 | 12.0 | 1.0 |

In the experiments conducted, the respective lamp as shown in Table 1 was lit in combination with a ballast and excess currents of varying levels passed through the light emitting tube by shortcircuiting the portions of the windings of the ballast during the lighting of the lamp. In this way, the time required for the light emiting tube to break was measured. In FIG. 4, O, □, ▽ and X represent 150 W, 400 W, 700 W and 1,000 W, respectively. As evident from FIG. 4, the smaller the inner diameter and wall thickness of the tube and the smaller the lamp input, the earlier the light emitting tube is broken, provided that the same excess current is supplied to the tube.

The following experiments were conducted to see whether the breakage of the light emitting tube results from the tube dimension or the tube input.

Experiment 2

Figure 5:
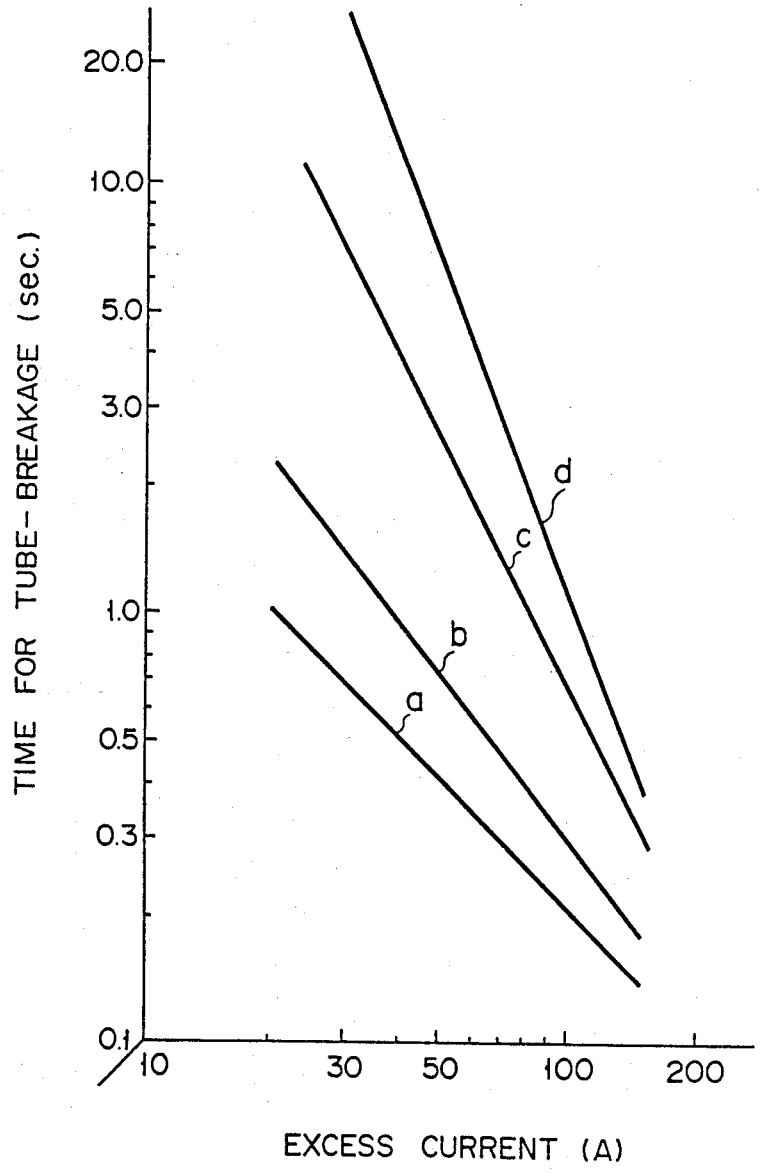
FIG. 5 is a graph showing a relation between an excess current when the inner diameter and wall thickness of a light emitting tube vary with the tube input fixed, and a time required for the breakage occur.

In these experiments, various lamps were prepared which used light-transmissive alumina ceramics light emitting tubes with the inner diameters of 5.5 mm to 12 mm and the wall thickness of 0.5 mm to 1 mm, noting that a load on the tube wall was kept at 18 W/cm$^2$ and that the length of the light emitting tube was adjusted to obtain an input of 400 W with respect to all the light emitting tubes. As in the case of Experiment 1, a varying excess current was passed through the light emitting tube during the lighting of the lamp, measuring a relation between the excess current and the time required for the light emitting tube to be break FIG. 5 shows the results of the experiments conducted, in which the lines a, b, c and d show 5.5 mm×0.5 mm, 7.25 mm×0.75 mm, 10 mm×1.0 mm and 12 mm×1.0 mm (the inner diameters D×the wall thickness t), respectively, noting that, in a plot of the times required for the light emitting tube to be broken by excess currents of different levels, these lines are obtained each by connecting corresponding data points so that all the corresponding data points are distributed above the corresponding line. As seen from FIG. 5, the smaller the inner diameter D and tube wall thickness t, the earlier the tube is broken despite the fact that the tube input and the load on the tube wall are fixed. From these it has been found that the inner diameter D and tube wall thickness t exert a greater influence over the breakage of the light emitting tube.

As will be apreciated from the above, the breakage of the light emitting tube occurs due to an excess rise by the excess current in the vapor pressure of the sealed materials in the tube, meaning that the thinner thickness of the tube causes a ready breakage and that with a smaller inner diameter of the tube a distance between a hot arc column induced in the tube and the tube wall is becomes small and thus high temperature is involved on the tube wall with the consequent ready breakage to the tube. The above-mentioned lines a to d can be expressed by the following equations,

| lines | D mm × t mm | equations |
|---|---|---|
| a | 5.5 × 0.5 | logT = −1.04 logI + 1.41. . . (2) |
| b | 7.25 × 0.75 | logT = −1.287 logI + 2.05. . . (3) |
| c | 10 × 1.0 | logT = −1.90 logI + 3.65. . . (4) |
| d | 12 × 1.0 | logT = −2.35 logI + 4.82. . . (5) |

where

I: the excess current amperes (A)

T: the time (seconds) required for the breakage to occur to the tube.

With the respective constants on the right side of the above equation, for example, the first and second items given by A and B, then $$\log T = A\log I + B \quad (6)$$

If the time T required for the tube to be broken is related to the level I Amperes (A) of the excess current and the inner diameter D and wall thickness t of the tube, then the respective constants A and B may be considered as a function of $D^2t$. In other words, the tube wall suffers a heat influence with a square of the distance from the acr center to the inner surface of the tube wall and the tube strength is determined by the tube thickness t.

Figure 6:
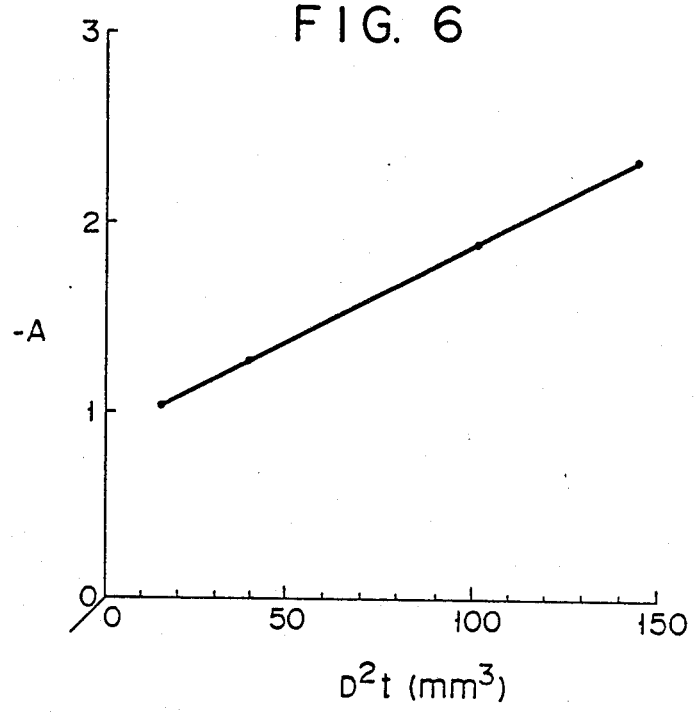
FIGS. 6 and 7 are graphs showing a relation between the constants A and B in an equation representing each straight line in FIG. 5 and $D^2t$.
Figure 7:
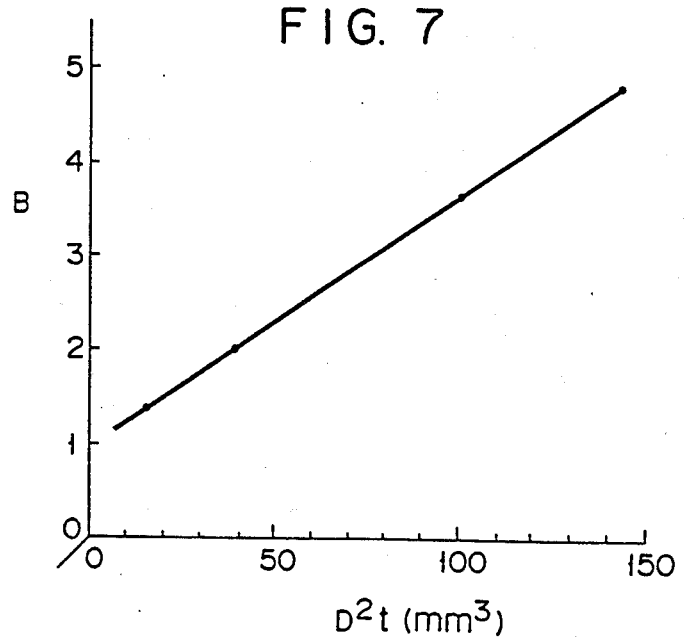

FIG. 6 is a graph showing a relation of $D^2t$ to the respective constant A in equations (2) to (5) and FIG. 7 shows a graph showing a relation of $D^2t$ to the constant B. From this, the following relations are obtained:

$$A = -1.02\times10^{-2}(D^2t) - 0.885 \quad (7)$$

$$B = 2.64\times10^{-2}(D^2t) + 1.01 \quad (8)$$

From the equations (6) to (8) it will be appreciated that the relation of the excess current to the breakage of the light emitting tube is given by:

$$\log T = A\log I + B$$

$$A = -1.02\times10^{-2}(D^2t) - 0.885$$

$$B = 2.64\times10^{-2}(D^2t) + 1.01$$

Since the fuse which is connected in series with the light emitting tube should be blown when an excess current flows therethrough, it is only necessary to use a fuse of a type having a blowing characteristic of:

$$\mathrm{Log}T_1 < A\log I + B \quad (9)$$

provided that, with $T_1$(seconds) representing the time required for the fuse to be blown, A and B satisfy the above equations (7) and (8).

Experiment 3

Figure 8:
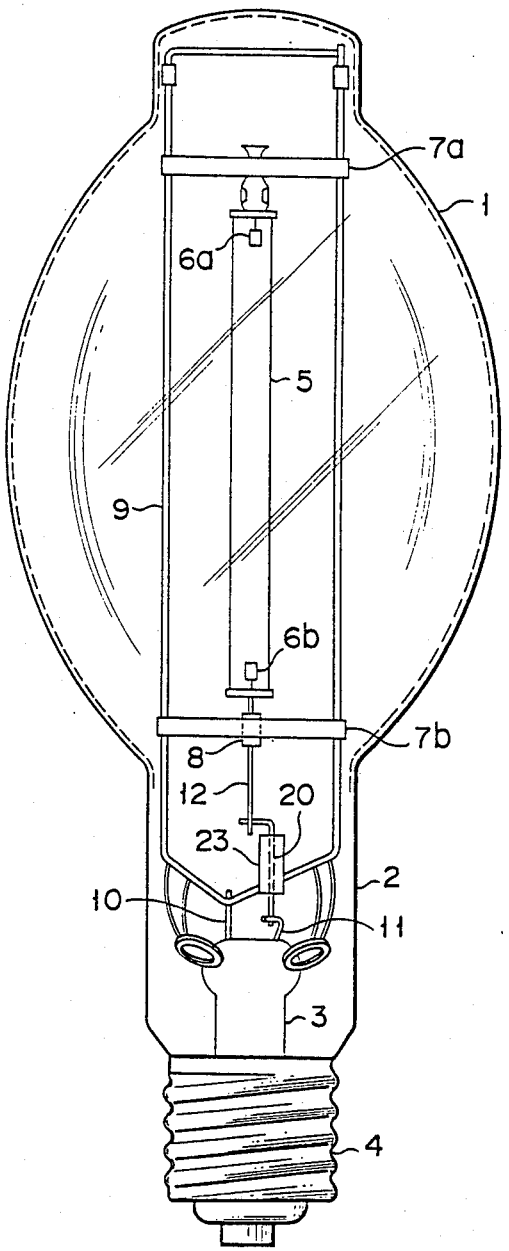
FIG. 8 is a front view showing a high-pressure sodium lamp used in experiments conducted.

High-pressure sodium lamps of 150 W to 1,000 W were prepared which have a different fuse (three types in all), noting that they are within a range satisfying the above equations (7), (8) and (9). They were tested for their lifetime. In FIG. 8 is shown a high-pressure sodium lamp comprising an outer tube 1 sealed with a stem 3 and having a neck section 2 and a base 4 fitted over the neck section 2. The lamp further includes a light emitting tube made of, for example, a ceramics material and having a pair of electrodes *6a, 6b* located opposite each other. A predetermined amount of a rare gas for starting, mercury and sodium are sealed in the light emitting tube. The light emitting tube 5 is supported by a pair of holders *7a, 7b* at both the ends with one holder *7a* electrically connected to the electrode *6a* and the other holder *7b* supporting one end of the light emitting tube 5 through an insulating member 8. The holders *7a, 7b* are connected to a support (feed line) 9 which is in turn connected to one weld 10 sealed in the stem 3. The electrode *6b* is connected to the other weld 11 through a feed line 12 for feeding electric power to the light emitting tube 5. A fuse 20 made of, for example, a 20 mm-long nickel wire is connected to the feed line 12 and covered by an insulating tube 23 made of a heat-resistant, electrically insulating material, such as hard glass. Table 2 below shows the input of the lamp tested, inner diameters and wall thickness of the light emitting tube and diameter of the fuse used.

TABLE 2

| lamp input | light emitting tube inner dia. D (mm) × wall thickness t (mm) | fuse diameter (mm) |
|---|---|---|
| 150 W | 5.5 × 0.5 | 0.3 |
| | | 0.35 |
| | | 0.4 |
| 400 W | 7.25 × 0.75 | 0.4 |
| | | 0.45 |
| | | 0.5 |
| 700 W | 10 × 1.0 | 0.6 |
| | | 0.65 |
| | | 0.7 |
| 1,000 W | 12 × 1.0 | 0.7 |
| | | 0.75 |
| | | 0.8 |

The inner diameter D and wall thickness t of the light emitting tubes for the respective lamps are the same as in Experiments 1 and 2. The lamps were repetitively lit and extinguished in a repetitive ON-OFF cycle in combination with a 200 V mercury lamp ballast with 10 lamps of each lamp used per one fuse of each diameter, noting that the ON and OFF time periods correspond to 5.5 hours and 0.5 hours, respectively, and that the rated current for the lighting period is 2.0 A for 150 W, 4.7 A for 400 W, 7.9 A for 700 W and 11.1 A for 1,000 W.

Figure 9:
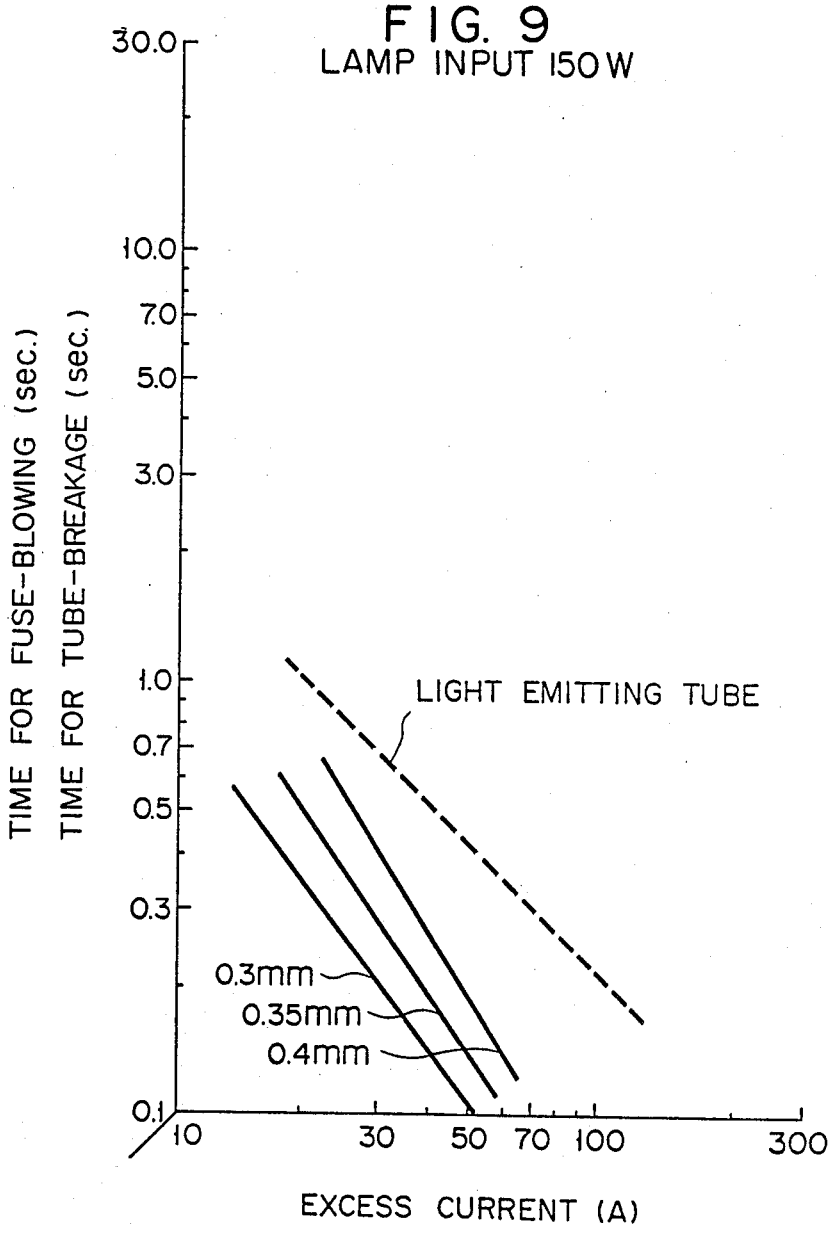
FIGS. 9 to 12 are graphs showing a comparison between the breakage characteristic of a light emitting tube of a high-pressure sodium lamp and the blowing characteristic of various fuses.

In a graph show in FIG. 9, the broken line shows the breakage characteristic of a 150 W light emitting tube on the basis of the equation (2) and the solid line shows the blowing characteristic of the respective fuses.

Figure 10:
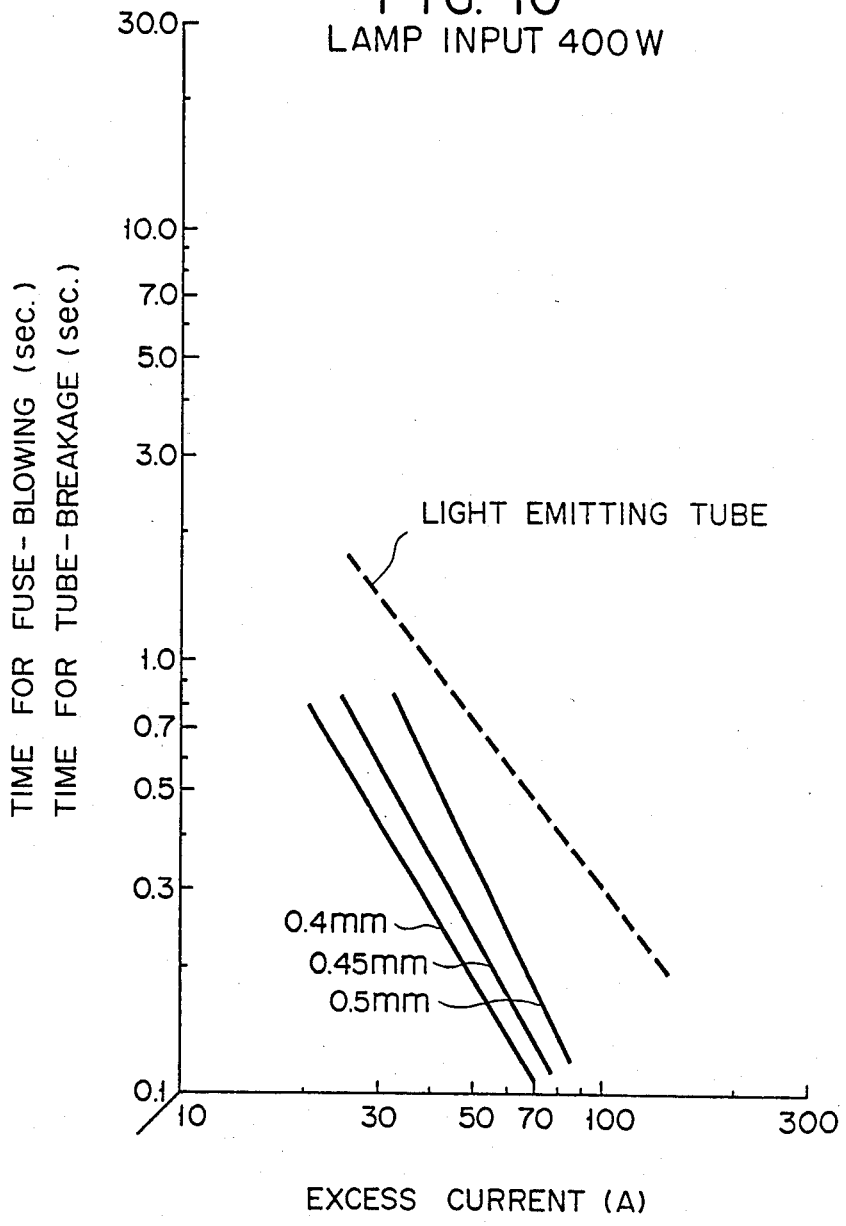
Figure 11:
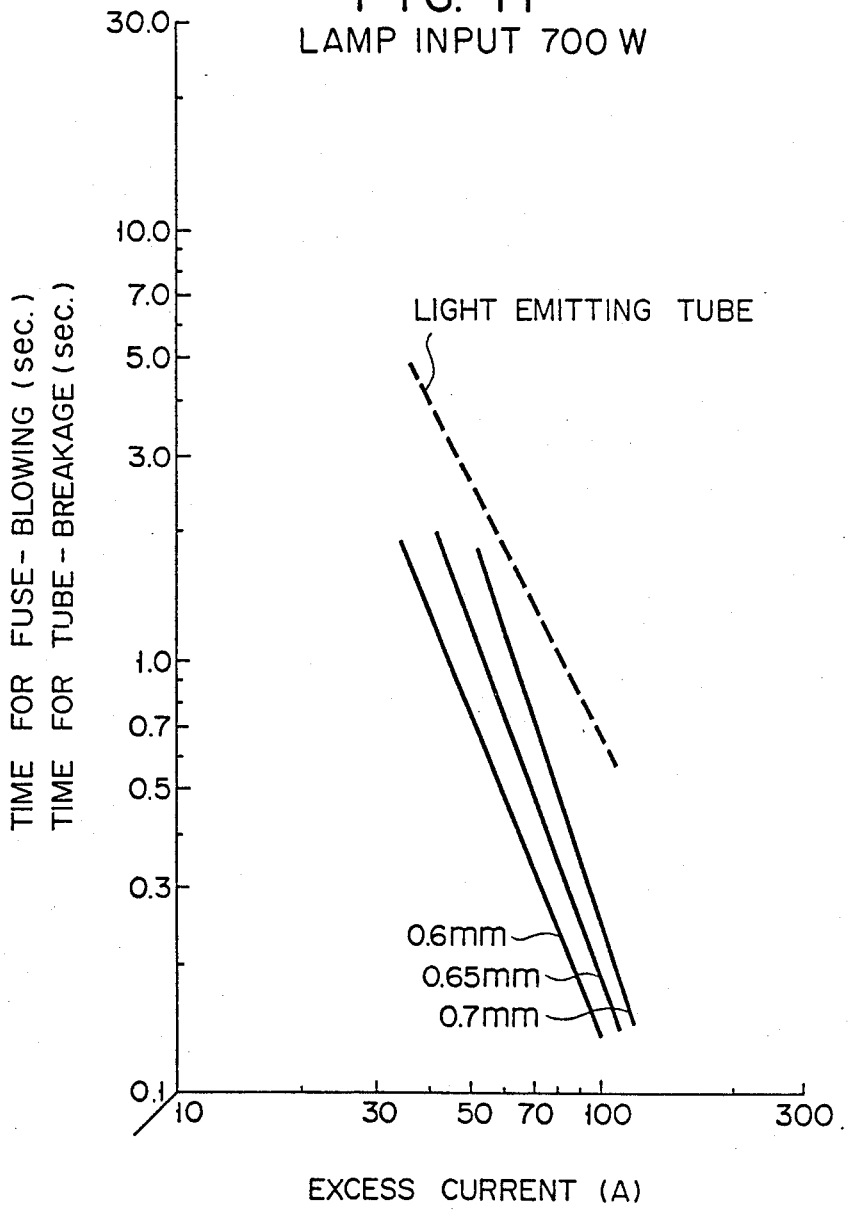
Figure 12:
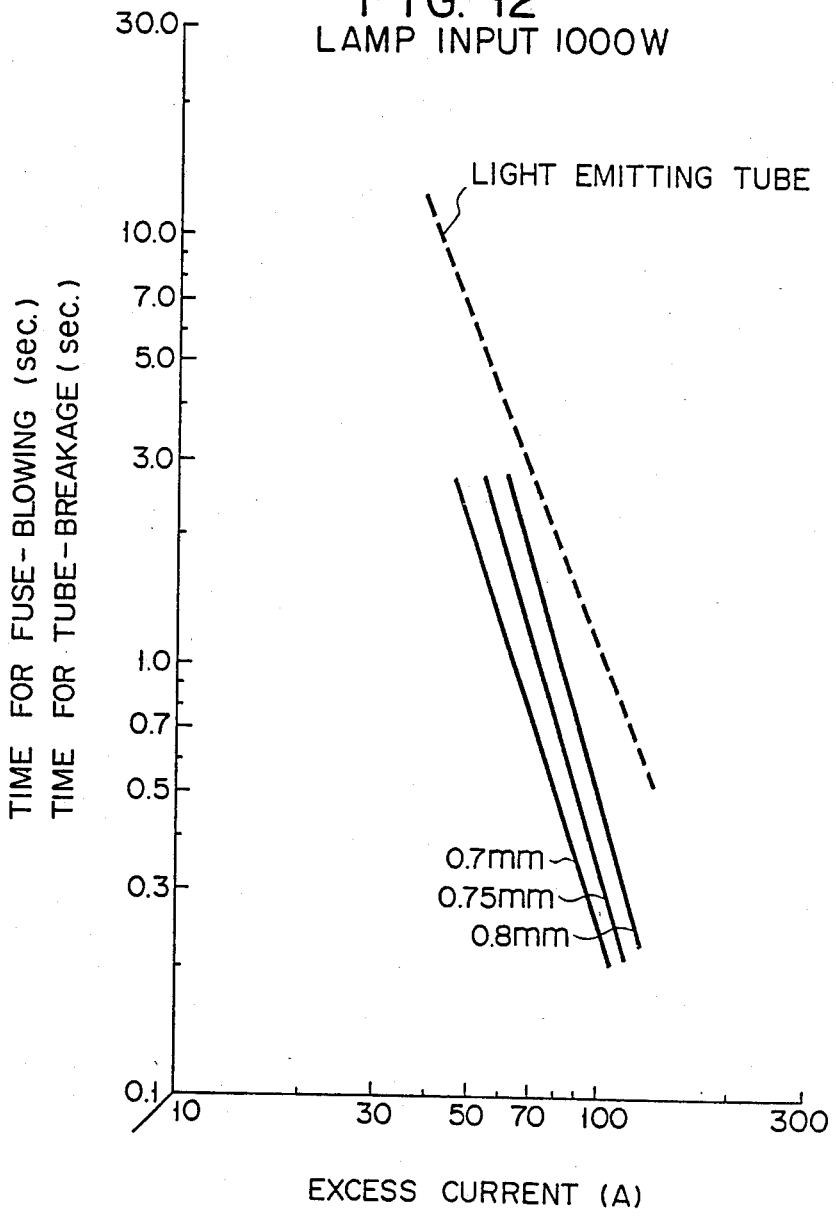

Similarly, FIG. 10 is a graph showing the breakage characteristic of the 400 W light emitting tube based on the equation (3) and blowing characteristic of fuses; FIG. 11 is a graph showing the breakage characteristic of the light emitting tube based on the equation (4) and blowing characteristic of fuses and FIG. 12 is a graph showing the breakage characteristic of the 1,000 W light emitting tube based on the equation (5) and blowing characteristic of fuses. From these it will be appreciated that, in all cases, the fuse is blown upon the flow of the excess current therethrough before the light emitting tube is broken, whereby it is possible to prevent the breakage of the light emitting tube. In FIGS. 9, 10, 11 and 12, the corresponding lamps went out at the excess current levels of below 15A, below 28A, below 40A and below 45A, respectively. However, there were some cases where even the fuse having such blowing characteristic, if it was deviated in blowing characteristic too far away from the breakage characteristic of the light emitting tube (i.e. if the diameter of the tube was too small), was blown during a rated lifetime of about 12,000 hours under the normal lighting condition free from any excess current to cause the lamp to cease to be lit.

Table 3 below shows an incidence of blowings of the respective fuses of 400 W lamps for which ON-OFF tests were conducted for a long duration of time.

TABLE 3

| lamp | fuse dia. (mm) | incidence of blowings (a cumulative %) hours 1,000 | hours 6,000 | hours 12,000 | current density in fuse ($A/mm^2$) |
|---|---|---|---|---|---|
| 400 W | 0.4 | 40 | 60 | 60 | 37.4 |
| | 0.45 | 20 | 20 | 30 | 29.6 |
| | 0.5 | 0 | 0 | 0 | 23.9 |

As understood from Table 3, at the rated lifetime during the lighting time up to 12,000 hours an incidence of blowings of the fuses is 0 at a current density of below 23.9 $A/mm^2$in the fuse and a high incidence of blowings of the fuses occurs at a current density in excess of 23.9 $A/mm^2$. Substantially the same results are also obtained for the other lamps of 150 W, 700 and 1,000 W.

The blowing of the fuse is probably due to the effect of heat upon the fuse during the lighting of the lamp and to the repetitive stresses on the fuse resulting from the expansion and contraction of the fuse per se, during the ON-OFF time of the lamp. Thus, the greater the current density in the fuse, the greater the self heat generation of the fuse. As a result, the fuse is softened by that extent and thus a greater expansion is involved, leading to a consequent breakage.

The result of the long-duration lifetime tests bears no relation to the configuration of the fuses. A similar result is also obtained for, for example, a circular and a rectangular cross-section. As the material of the fuse, use may be made of not only nickel, but also a nickel-copper alloy and the other metals such as a constantan on Monel metal. In this case, the same results can also be obtained.

If use is made of a fuse having a current density of 23.9 $A/mm^2$at a rated output during the lighting of the lamp and satisfying the following blowing characteristic of $$\log T_1 < A \log I + B$$
$$A = -1.02 \times 10^{-2}(D^2t) - 0.885$$
$$B = 2.64 \times 10^{-2}(D^2t) + 1.01,$$

then any possible breakage of the light emitting tube can be positively prevented if any excess current flows therethrough throught the whole lifetime of the lamp. It is also possible to avoid a possible short liftime of the lamp resulting from the blowing of the fuse during the ordinary lighting time.

A modification of this invention will be explained below, according to which it is possible to prevent the scattering of a blown fuse as well as the sagging of a fuse resulting from a rise in temperature.

Figure 13:
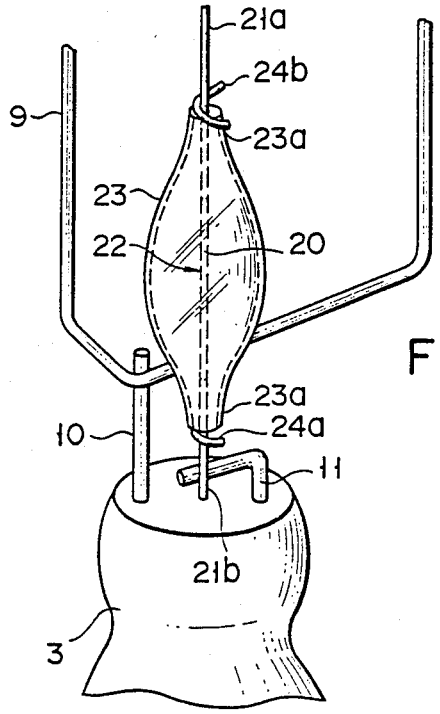
FIGS. 13 to 18 are diagrammatic views showing modified forms of this invention including fuses, each of which is disposed in an insulating tube.
Figure 14:
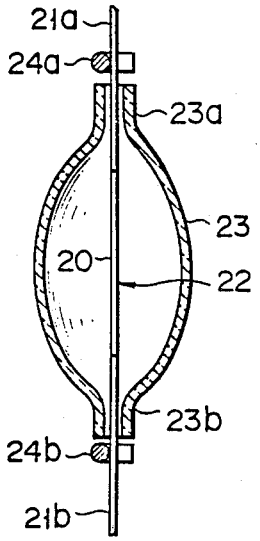

In FIGS. 13 and 14, a fuse member 22 comprises a fuse 20 constituted by, for example, nickel or a nickel alloy and lead wires 21*a* and 21*b* connected to both the ends of the fuse and made of, for example, tungsten. The fuse member 22 extends through an insulating tube 23 made of a heat-resistant insuling material such as hard glass and having diameter-reduced ends 23*a* and 23*b*. In this connection it is to be noted that the fuse member 22 is not sealed at the ends 23*a* and 23*b* of the tube 23. Stoppers 24*a*, 24*b* made of, for example, tungsten, nickel or stainless are jointed by weldering to those portions of the fuse member 22 where the fuse member extends out of the insulating tube.

Figure 2:
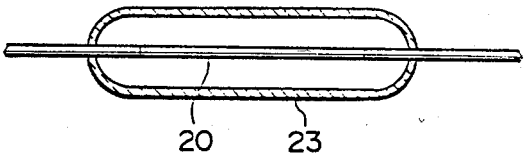
Figure 3:
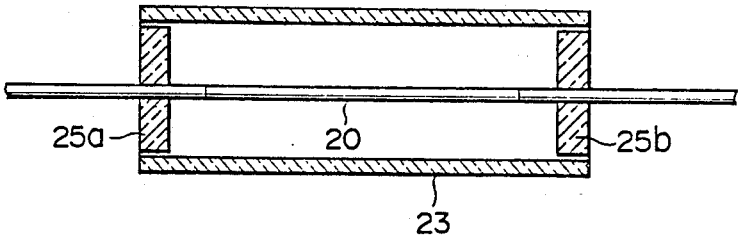

Tests were conducted by flowing an excess current through the high-pressure sodium lamp of FIG. 8 into which the fuse member as shown in FIGS. 13 and 14 is incorporated. For a relatively small excess current level, the fuse sometimes sagged, but no shorting resulting from its contact with the other metal members in the outer tube occurred owing to the presence of the insulating tube 23. Even where a blowing occurred due to a large excess current through the fuse 20, the scattered fargments of the blown fuse were shielded by the insulating tube 23 around the fuse and its diameter-reduced ends where a small clearance is formed relative to the rest of the tube 23. As a result, these fragments were not deposited onto the inner surface of the outer tube 1 and, furthermore, the outer tube 1 was never broken due to the scattered fragments of the blown fuse. Since the fuse member 22 merely extends through the insulating tube 23 without being fixed to the nearby tube 23, even if the fuse member is thermally expanded outwards with a rise in temperature any crack never occurs unlike the cases where the insulating tube 23 is sealed at its ends as shown in FIG. 2. In addition, it is not necessary to provide any such sealed ends. The same effect as in the conventional lamp is obtained without using the blocking members 25*a*, 25*b* as in the embodiment of FIG. 3. It is possible to save the material cost for the blocking members and any additional step of fixing the fuse to the blocking members is unnecessary, assuring a low-cost lamp.

Figure 1:
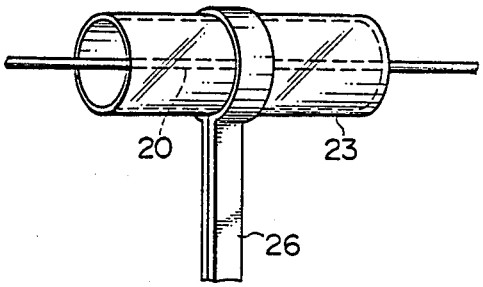
FIGS. 1 to 3 show a fuse which is disposed in an insulating tube incorporated in each of the conventional lamps.

In this embodiments as shown in FIGS. 13 and 14, stoppers 24*a* and 24*b* are jointed to those ends 23*a* and 23*b* of an insulating tube 23 for a fuse member 22. This requires only a simpler operation whereby any unauthorized displacement of the tube 23 can be prevented and thus the tube can be located around a fuse 20, thus providing an adequate shielding to the fuse. It may be added that it is not necessary according to this invention to provide any support 26 to the insulating tube 23 as shown in FIG. 1.

Although, in the embodiment as shown in FIGS. 13 and 14, the fuse member 22 has been explained as having its fuse connected at both the ends to the lead wires 21*a* and 21*b*, but this invention is not restricted thereto. The feed line 12 (of FIG. 8) per se may be used as the lead wire in place of any separate lead wire, or the whole fuse member 22 may be replaced by a single fuse unit 20 in place of any separate lead wire in which case stoppers 24*a* and 24*b* may be formed at those portions of the tube ends 23*a* and 23*b* where the fuse member extends out of the tube 23.

Figure 15:
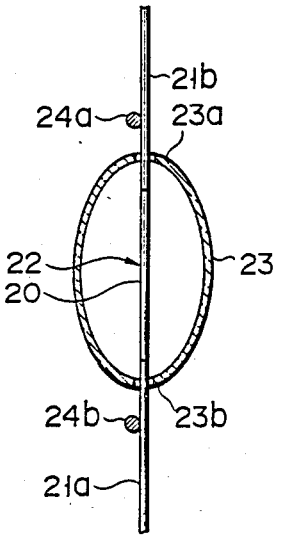
Figure 16:
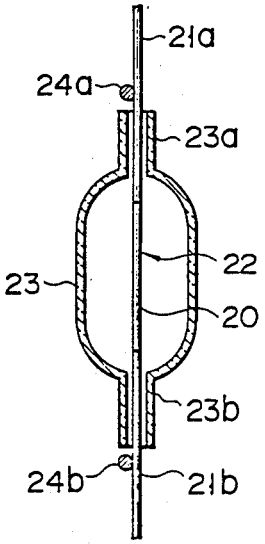
Figure 17:
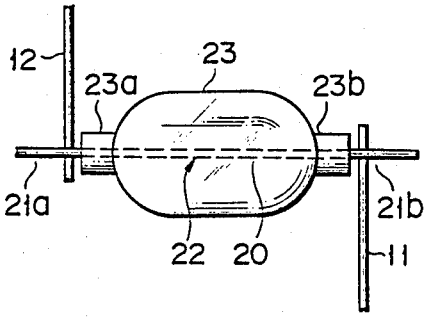
Figure 18:
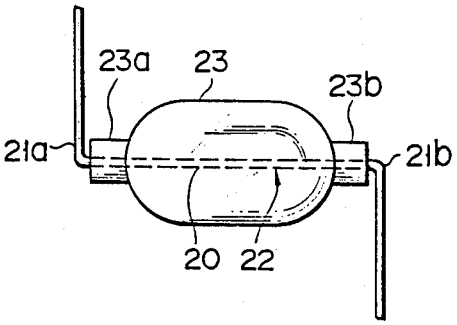

FIGS. 15 to 18, each, show a modification of this invention, noting that the arrangement of FIGS. 15 and 16 is directed to a specific form of an insulating tube and that the arrangement of FIGS. 17 and 18 is directed to a specific form of stoppers. In FIGS. 15 to 18, identical reference numerals are employed to designate identical parts or elements of the lamp.

FIG. 15 shows the insulating tube 23 having very short, diameter-reduced ends 23*a* and 23*b* in comparison with the middle of the tube 23. In this embodiment, however, the tube is preferably formed to have a tube end length of, for example, around 5 mm or more in which case it is possible to reduce any discrepancy between the axis of the tube 23 and the longitudinal axis of the fuse member 22. It is also preferable that a dropping of the tube 23 away from the fuse take-out portion can be prevented during the blowing of the fuse. FIG. 16 shows the tube 23 having a straight tube-like middle section according to which the same advantage can be obtained. The tube 23 is not restricted to such a configuration except that the tube end portions 23*a*, 23*b* should be diameter-reduced as shown in FIG. 16.

In the arrangement of FIG. 17, a Copper Welded Wire 11 and feed line 12 are fixed in a crisscross fashion to those corresponding tube end portions 23*a*, 23*b* where a fuse member 22 extends out of the insulating tube 23. In this arrangement, the Copper Welded Wire 11 and feed line 12 serve as stoppers, thus obviating the necessity of providing any separate stoppers 24*a*, 24*b*. As a result, the manufacturing steps required can be decreased, assuring a low-cost lamp unit. The fuse member 22 may be located between separated feed lines, in place of arranging it between the Copper Welded Wire 11 and the feed line 12, such that the end portion of the respective feed lines intersect the corresponding extensions of the fuse member 22 as in the case of the arrangement of FIG. 17, thereby obtaining a stopper function.

In the arrangement shown in FIG. 18, a fuse member 22 may have those bent portions at both the ends where the member 22 extends out of an insulating tube 23. In this arrangement, the bent portions of the fuse member 22 act as stoppers, thus obtaining the same advantage as in the arrangement of FIG. 17.

This invention is not restricted to the above-mentioned embodiments. For example, the fuse member 22 may be located not on the side of the feed line 12, but on the side of the feed circuit connecting the electrode 6*a* to the support 9 of FIG. 8 which serves also as the opposite feed line. The insulating tube 23 may be made of, in addition to glass, a heat-resistant, insulating material such as quartz glass or ceramics material.

With the above-mentioned modifications of this invention, the end portions of the insulating tube are diameter-reduced relative to the middle portion thereof and the stoppers are formed at those portions of the fuse member where the fuse member extends out of the tube, providing the following advantages (a) to (d):

(a) The insulating tube can readily be located around the fuse without using any conventional support means.

(b) When the fuse is blown due to the excess current therethrough, the scattering of the fragments of the blown fuse can be prevented, thereby preventing a breakage to the outer tube.

(c) Shortcircuiting can be completely prevented due to the contacting of the fuse with the nearby metal member by the sagging of the fuse with a rise in temperaure.

(d) The fuse member can readily be assembled at loss costs during the manufacture of the lamp.

What is claimed is:

1. A high-pressure metal vapor discharge lamp comprising:

an outer tube, a light emitting tube located within the outer tube and made of a light-transmissive ceramics material and having electrodes sealed at opposite ends thereof, and a fuse electrically connected in series with the light emitting tube and positioned within the outer tube, in which said fuse has such a blowing characteristic as given by the following equation and (at a rated output during the lighting of the lamp the density of a current through the fuse is not more than 23.9 A/mm$^2$the density of a current through the fuse at a rated output during the lighting of the lamp is not more than 23.9 A/mm$^2$.

$\log T_1 < A \log I + B$ wherein, $A = -1.02 \times 10^{-2}(D^2t) - 0.885$ $B = 2.64 \times 10^{-2}(D^2t) + 1.01$, T1: required blowing time (seconds) of the fuse, I : blowing current (A) of the fuse, D : inner diameter (mm) of the light emitting tube, and t : wall thickness (mm) of the light emitting tube.

2. A high-pressure metal vapor discharge lamp according to claim 1, in which the length of said fuse is 15 to 20 mm.

3. A high-pressure metal vapor discharge lamp according to claim 1, in which said fuse is enclosed by an insulating tube.

4. A high-pressure metal vapor discharge lamp according to claim 3, in which said insulating tube is diameter-reduced at its end portions, lead wires are connected to the corresponding ends of said fuse, said fuse and said lead wires comprise a fuse member which is not sealed at both end portions of said insulating tube, and stoppers are provided at those portions of the fuse member where said fuse member extends out of the ends of the said insulating tube.

5. A high-pressure metal vapor discharge lamp according to claim 4, in which said stoppers are wires which are mounted in such a manner as to intersect the corresponding lead wires at a substantially right angle.

6. A high-pressure metal vapor discharge lamp according to claim 4, in which said stoppers are formed by bending at a substantially right angle those portions of said fuse member where said fuse member extends out of said end portions of said insulating tube.

* * * * *